US009484672B2

(12) United States Patent
Maier et al.

(10) Patent No.: US 9,484,672 B2
(45) Date of Patent: Nov. 1, 2016

(54) ADAPTER FOR USB AND HSD INTERFACES

(71) Applicant: ROSENBERGER HOCHFREQUENZTECHNIK GMBH & CO KG, Fridolfing (DE)

(72) Inventors: Johannes Maier, Traunstein (DE); Volker Pangritz, Moosdorf (AT)

(73) Assignee: Rosenberger Hochfrequenztechnik GmbH & Co, KG, Fridolfing (DE)

( * ) Notice: Subject to any disclaimer, the term of this patent is extended or adjusted under 35 U.S.C. 154(b) by 0 days.

(21) Appl. No.: 14/766,269

(22) PCT Filed: Feb. 11, 2014

(86) PCT No.: PCT/EP2014/000373
§ 371 (c)(1),
(2) Date: Aug. 6, 2015

(87) PCT Pub. No.: WO2014/124746
PCT Pub. Date: Aug. 21, 2014

(65) Prior Publication Data

US 2015/0372426 A1 Dec. 24, 2015

(30) Foreign Application Priority Data

Feb. 14, 2013 (DE) ..... 20 2013 001 452 U

(51) Int. Cl.
*H01R 24/00* (2011.01)
*H01R 13/6461* (2011.01)
(Continued)

(52) U.S. Cl.
CPC ..... *H01R 13/6461* (2013.01); *H01R 13/6581* (2013.01); *H01R 24/60* (2013.01); *H01R 24/62* (2013.01); *H01R 31/06* (2013.01); *H01R 2107/00* (2013.01)

(58) Field of Classification Search
CPC .. H01R 23/025; H01R 31/06; H01R 31/065; H01R 27/02; H01R 2103/00; H01R 13/658; H01R 13/26; H01R 23/7073; H01R 23/02; H01R 23/725; H01R 13/6658; H05K 1/0228; H05K 2201/10189
USPC ..... 439/638, 660, 676, 655, 680
See application file for complete search history.

(56) References Cited

U.S. PATENT DOCUMENTS 5,906,511 A * 5/1999 Bozzer ..... H01R 13/65807 439/579
6,991,483 B1 * 1/2006 Milan ..... H01R 31/06 439/171

(Continued)

FOREIGN PATENT DOCUMENTS

DE 102009019137 A1 11/2010
WO 2010118807 A1 10/2010
WO 2011057691 A1 5/2011

*Primary Examiner* — Abdullah Riyami
*Assistant Examiner* — Vladimir Imas
(74) *Attorney, Agent, or Firm* — DeLio, Peterson & Curcio, LLC; Robert Curcio

(57) ABSTRACT

An adapter having a first electrical interface and a second electrical interface which each have contact elements for transmitting data (data contact elements) and for transmitting electric supply energy (supply contact elements), the contact elements of the first interface being connected to the corresponding contact elements of the second interface via conductors. A first supply contact element of the first interface is connected to two first supply contact elements of the second interface and a second supply contact element of the first interface is connected to a second supply contact element of the second interface, the second supply contact element of the second interface being in the form of an external conductor surrounding the other contact elements.

17 Claims, 2 Drawing Sheets

(51) Int. Cl.

| | |
|---|---|
| ***H01R 24/62*** | (2011.01) |
| ***H01R 31/06*** | (2006.01) |
| ***H01R 13/6581*** | (2011.01) |
| ***H01R 24/60*** | (2011.01) |
| *H01R 107/00* | (2006.01) |

(56) References Cited

U.S. PATENT DOCUMENTS 7,004,787 B2 * 2/2006 Milan ..... H01R 31/06 439/502
7,318,750 B1 * 1/2008 Chacon ..... H01R 27/02 200/51.03
7,322,857 B2 * 1/2008 Chen ..... H01R 12/7041 439/623
7,520,782 B1 * 4/2009 Huang ..... H01R 31/06 439/516
7,666,007 B2 * 2/2010 Hsu ..... H01R 13/6658 235/492
7,722,407 B2 * 5/2010 Momose ..... H05K 1/0216 439/108
7,830,154 B2 * 11/2010 Gale ..... H01R 31/06 324/538
7,878,833 B2 * 2/2011 Chen ..... H01R 13/5045 439/284
7,988,469 B1 * 8/2011 Sun ..... H01R 31/06 439/140
8,628,354 B2 * 1/2014 Huber ..... H01R 13/6593 439/607.01
8,777,670 B2 * 7/2014 Blakborn ..... H01R 31/06 439/638
9,160,822 B2 * 10/2015 Joseph ..... H01R 31/06
9,281,628 B2 * 3/2016 Wu ..... H01R 13/6582
2004/0229508 A1 * 11/2004 Miyazaki ..... H01R 9/0521 439/607.01
2008/0242133 A1 * 10/2008 Herlitz ..... H01R 31/06 439/166
2009/0104819 A1 * 4/2009 Hermant ..... H01R 13/6593 439/638
2010/0258333 A1 10/2010 Horan et al.
2012/0045943 A1 * 2/2012 Huber ..... H01R 13/6593 439/660
2012/0270447 A1 * 10/2012 Blakborn ..... H01R 31/06 439/655
2014/0216781 A1 * 8/2014 Shen ..... H01R 31/06 174/102 R
2015/0372426 A1 * 12/2015 Maier ..... H01R 24/62 439/676

* cited by examiner

ADAPTER FOR USB AND HSD INTERFACES

BACKGROUND OF THE INVENTION

1. Field of the Invention

The invention relates to an adapter having a first electrical interface and a second electrical interface which each have contact elements for transmitting data and for transmitting electrical supply voltage, the contact elements of said first interface being connected to the corresponding contact elements of said second interface via conductors. In particular, the invention relates to an adapter for connecting a USB interface to a High Speed Data (HSD) interface.

2. Description of Related Art

Plug connectors with a USB interface are characterized through a rectangular interface geometry as well as through the arrangement of either two or all four of the contact elements next to one another in a plane. In contrast, the total of four inner contact elements of plug connectors with an HSD interface are positioned in a quad arrangement and the interface geometry is round. In a USB interface, two of the four contact elements are provided for the transmission of data signals, while electrical supply energy is transmitted via the two further contact elements. In HSD interfaces, the four inner contact elements regularly serve the purpose of a double differential signal transmission, wherein the two contact elements of the two transmission pairs are each arranged opposite one another in the quad arrangement. This arrangement in combination with a shield surrounding the contact elements guarantees transmission at a high bit rate with good electromagnetic shielding and good crosstalk attenuation. HSD plug connectors are regularly connected with shielded cables in which four conductors are provided in a star quad arrangement which can in addition be twisted together.

It is known for an HSD circuit board plug connector and a USB circuit board plug connector to be arranged on a circuit board and connected together electrically via the circuit board. In this way, an adapter is created through which two mating plug connectors with USB or HSD interface can be connected together.

Also known from WO 2011 057691 A1 is an adapter of the generic type in which the USB interface and the HSD interface are formed in a housing and the respective contact elements of the two interfaces are connected together via single-part conductors, whereby the two contact elements of the USB interface used for data transmission are connected with two diagonally opposite contact elements of the HSD interface, while the two contact elements of the USB interface used for electrical supply energy are connected with the two remaining inner contact elements of the HSD interface. The HSD interface in the adapter known from WO 2011 057691 A1 and a cable connected with this are thus not used for double differential signal transmission but for single differential signal transmission with simultaneous transmission of a supply voltage.

The object of the adapter known from WO 2011 057691 A1 is to connect, in a simple and economical manner, a USB connection with HSD-specific components in order to make use of their good transmission properties. This adapter can in particular be used in motor vehicles, which regularly have USB interfaces in their interior to which multimedia players can be connected, with the further transmission of data, in particular to a control device arranged at a distance, taking place via the HSD components which are widely used in automotive engineering.

SUMMARY OF THE INVENTION

Starting out from this prior art, the invention was based on the problem of providing an improved adapter of the generic type.

This problem is solved through an adapter according to the claims. A system according to the invention consisting of such an adapter and a cable connected with this is the subject matter of the claims. Advantageous embodiments of the adapter according to the invention and of the system according to the invention are the subject matter of the various dependent claims and are explained in the following description of the invention.

The above and other objects, which will be apparent to those skilled in the art, are achieved in the present invention which is directed to an adapter comprising a first electrical interface and a second electrical interface which each have data contact elements for transmitting data and supply contact elements for transmitting electrical supply energy, wherein the contact elements of the first interface are connected with the corresponding contact elements of the second interface via conductors, such that a first supply contact element of the first interface is connected with two first supply contact elements of the second interface and a second supply contact element of the first interface is connected with a second supply contact element of the second interface, which is in the form of an external conductor surrounding the other contact elements.

The first interface is designed as a USB interface and the second interface is designed as an HSD interface. The conductors may be in the form of stamped and bent components. And may be formed integrally with the associated contact elements.

The conductor connecting the first supply contact element of the first interface with the two first supply contact elements of the second interface is preferably shaped in a Y-form.

The conductor connecting the second supply contact element of the first interface with the second supply contact element of the second interface is designed as a spring contact tab which presses against the second supply contact element of the second interface in a spring-loaded manner.

The second supply contact element of the second interface may be sleeve-formed and the conductor makes contact with the inner side thereof.

In a second aspect, the present invention is directed to a system comprising an adapter and a cable, the adapter having: a first electrical interface and a second electrical interface which each have data contact elements for transmitting data and supply contact elements for transmitting electrical supply energy, wherein the contact elements of the first interface are connected with the corresponding contact elements of the second interface via conductors, such that a first supply contact element of the first interface is connected with two first supply contact elements of the second interface and a second supply contact element of the first interface is connected with a second supply contact element of the second interface, which is in the form of an external conductor surrounding the other contact elements; and the cable connected with the adapter via the second interface, the cable having four conductors which are arranged in a star quad arrangement and which are connected in an electrically conductive manner with four contact elements of the second interface, as well as an external conductor which is connected in an electrically conductive manner with the external conductor of the second interface.

The cable is connected with the adapter via a plug connector with an interface complementary to the second interface of the adapter.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT(S)

Figure 1:
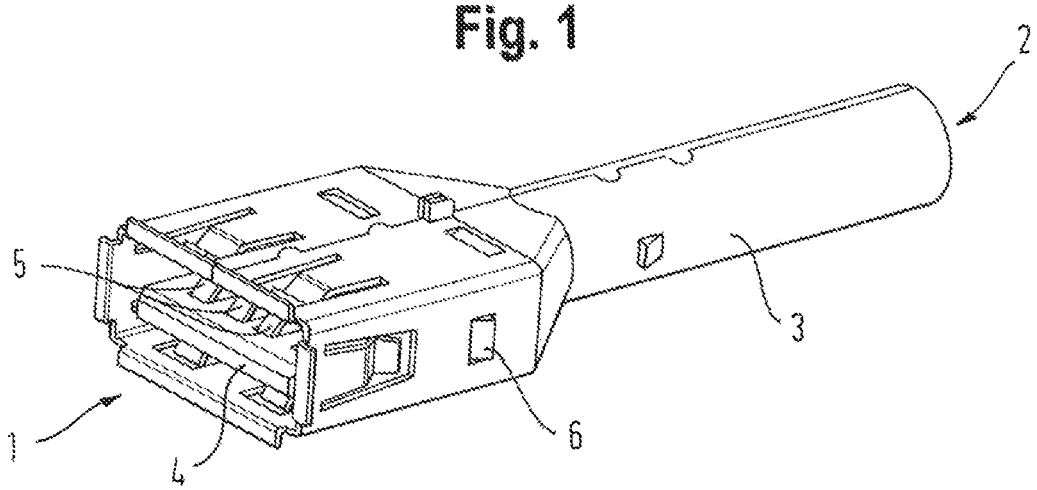
FIG. 1 shows a first perspective view of an adapter according to the invention.
Figure 2:
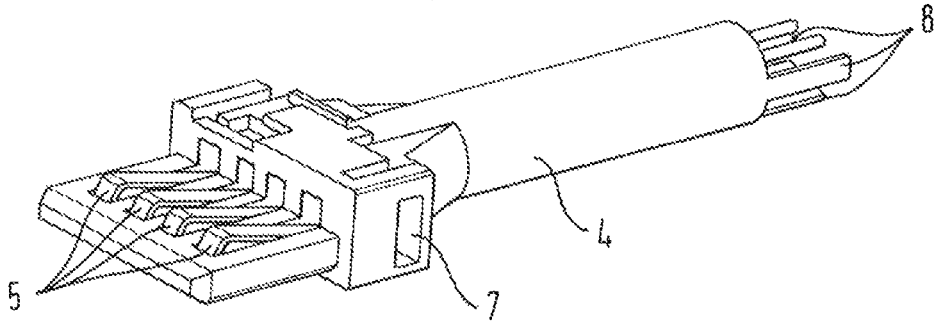
FIG. 2 shows the adapter in the view shown in FIG. 1, but without the external conductor.
Figure 3:
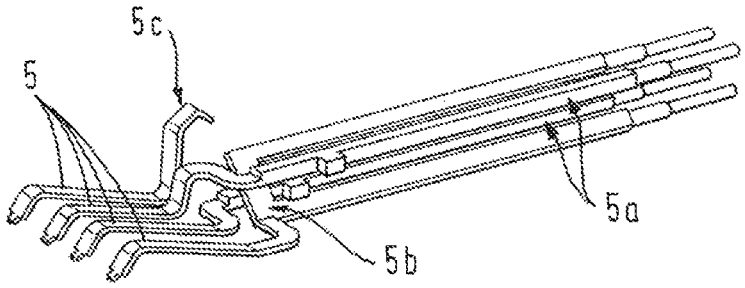
FIG. 3 shows the adapter in the view shown in FIG. 1, but without the external conductor and insulating body.
Figure 4:
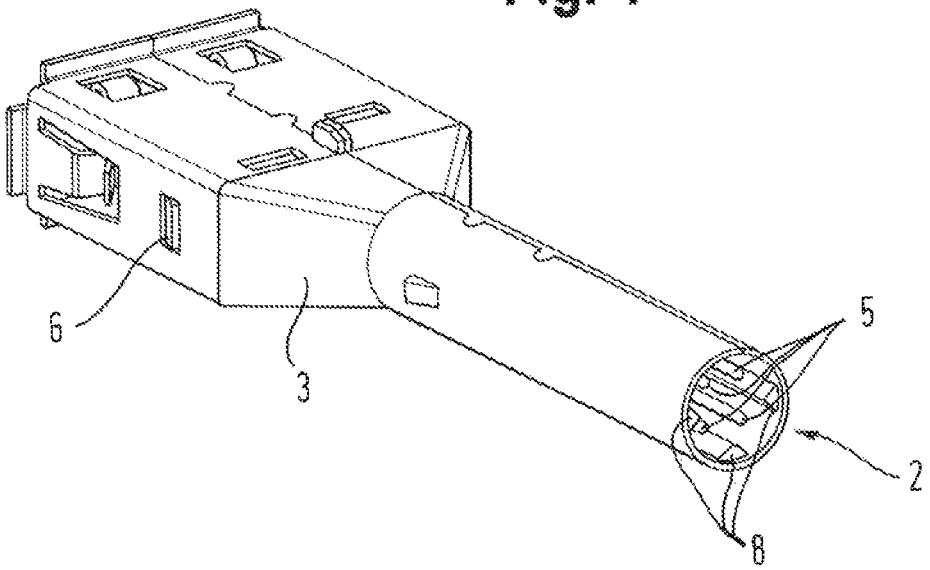
FIG. 4 shows a second perspective view of the adapter.
Figure 5:
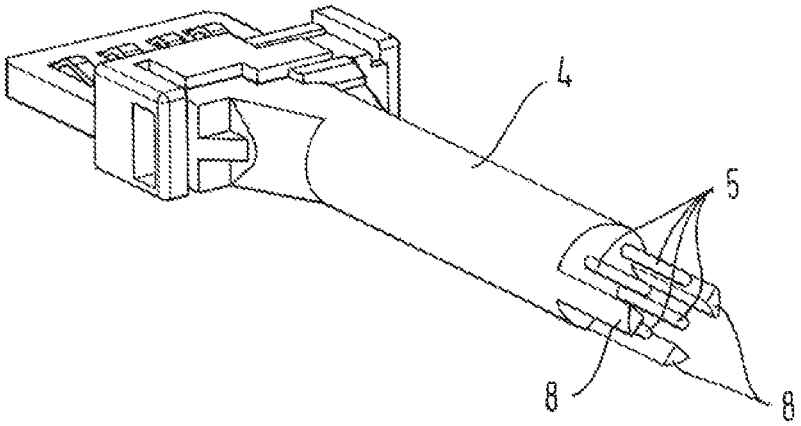
FIG. 5 shows the adapter in the view shown in FIG. 4, but without the external conductor.
Figure 6:
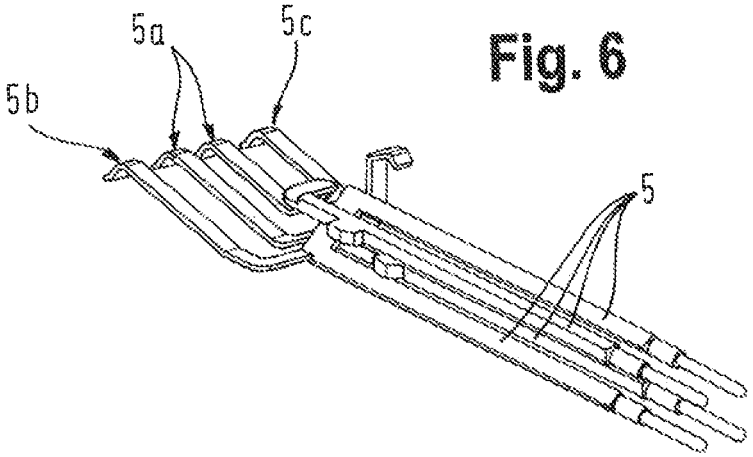
FIG. 6 shows the adapter in the view shown in FIG. 4, but without the external conductor and insulating body.

In describing the preferred embodiment of the present invention, reference will be made herein to FIGS. 1-6 of the drawings in which like numerals refer to like features of the invention.

According to the invention, an adapter of the generic type with a first electrical interface and a second electrical interface which each have contact elements for transmitting data (data contact elements) and for transmitting electrical supply energy (supply contact elements), wherein the contact elements of the first interface are connected with the corresponding contact elements of the second interface via (electrical) conductors, is further developed in that a first supply contact element of the first interface is connected with two first supply contact elements of the second interface and a second supply contact element of the first interface is connected with a second supply contact element of the second interface, which is in the form of an external conductor surrounding the other contact elements.

Preferably, the first interface can be designed as a USB interface and can, accordingly, have a rectangular interface geometry, preferably formed by a housing (which can also simultaneously represent an external conductor and in particular a shield) of the adapter, as well as having at least two (preferably four) of the contact elements arranged in a row. It can also preferably be the case that the second interface is designed as an HSD interface and, accordingly, has a round (in particular circular or oval) interface geometry, preferably formed by a housing (which can also simultaneously represent an external conductor and in particular a shield) of the adapter, a quad arrangement of four contact elements and an external conductor surrounding the contact elements.

Accordingly, according to the invention it can be the case that a supply contact element of the USB interface is split, for example via a Y-conductor, to two supply contact elements of the HSD interface, and the external conductor of the HSD interface normally serving as a shield in the case of HSD components, and in the present case additionally serving as a shield, is connected with the other supply contact element of the USB interface. Particularly preferably, the outer conductor and the supply contact element connected thereto are intended for connection to ground.

Accordingly, a system according to the invention comprises an adapter according to the invention and a cable, connected with the adapter via the second interface, which has four conductors which are arranged in a star quad arrangement and which are connected in an electrically conductive manner with four contact elements of the second interface, as well as an external conductor which is connected in an electrically conductive manner with the external conductor of the second interface. It can preferably be the case that the cable is connected with the adapter via a plug connector with an interface complementary to the second interface of the adapter. Also preferably, the first interface can also be part of a plug connector to which a plug connector with complementary interface can be connected. However, it is also possible to establish the connection of one or both interfaces (and in particular the second interface) with further continuing cables by means of a direct or permanent connection, for example in that the corresponding contact elements of the adapter are crimped together with the conductors of the cable.

The additional use, in comparison with the prior art (see WO 2011 057691A1), of the external conductor of the second (HSD) interface as well as of a cable connected thereto for transmission of the electrical supply energy (preferably direct current voltage) allows the total resistance to be reduced or, conversely, allows a thinner cable to be used, keeping down costs and weight, which is of great importance in the field of automotive engineering in particular. A further advantage resulting from the splitting of a first supply contact element of the first interface to two first supply contact elements of the second interface, for example through a Y-conductor, is the possibility of sending a test signal via a conductor which is connected to one of the two first supply contact elements of the second interface and receiving this again via a further conductor which is connected to the other of the two first supply contact elements of the second interface, which as a result of the connection of the two first supply contact elements (for example by means of the Y-conductor) is possible without any further measures (for example bridging). This makes it possible, for example, to check whether the connection between the adapter according to the invention and a head unit has been established correctly. This can in particular be relevant if one or more plug connections are integrated in this connection, as can for example be the case in an HSD network in a motor vehicle. This thus makes it possible to check in a simple manner whether all the plug connections have been made correctly. Such a testing method is also the subject matter of the present invention.

In order to achieve a simple and economical design of the adapter according to the invention it can preferably be the case that conductors connecting one or more, preferably all of the contact elements of the interfaces are in the form of stamped or stamped and bent components (possibly with (an) additional deformation step(s), for example embossing of the contact element(s)).

Also preferably, it can be the case that the conductors are integral and in particular formed in a single piece with the contact elements connected by said conductors.

Particularly preferably, it can thereby be the case that the conductor connecting the first supply contact element of the first interface with the two first supply contact elements of the second interface is shaped in a Y-form. Such a Y-formed conductor can also preferably be formed in a single piece, in particular as a stamped and bent component. In this way, a Y-conductor by means of which a supply contact element of the first (preferably USB) interface can be connected with the two supply contact elements of the second (preferably HSD) interface can be created simply and economically.

Alternatively, it is also possible to design the Y-conductor with two conductor sections, wherein a first conductor section forms (preferably integrally) the first supply contact element of the first interface and one of the first supply contact elements of the second interface, and a second conductor section forms (preferably integrally) the other of the first supply contact elements of the second interface and makes contact with the first conductor section in an electrically conductive manner at a contact point. The first conductor section and the second conductor section can thereby preferably be connected at the contact point through material bonding (for example by soldering or welding).

In a further preferred embodiment of the adapter according to the invention it can be the case that the conductor connecting the second supply contact element of the first (preferably USB) interface with the second supply contact element (i.e. the external conductor) of the second (preferably HSD) interface is designed as a spring contact tab which presses against the second supply contact element of the second interface in a spring-loaded manner. Particularly preferably, it can thereby be the case that the second supply contact element, i.e., the external conductor of the second interface, is sleeve-formed and the conductor makes contact with the inner side thereof. Again, this allows a simple and economical design of the adapter to be achieved.

The drawings show an exemplary embodiment of an adapter according to the invention for connecting a USB interface 1 to a HSD interface 2.

The adapter comprises a metallic external conductor 3, which simultaneously represents a housing of the adapter and defines the outer interface geometry for both interfaces. The outer interface geometry of the USB interface 1 is rectangular (see FIG. 1), whereas that of the HSD interface 2 is circular (see FIG. 4).

A total of four (inner) conductors 5 are arranged within the external conductor 3 and electrically insulated from this by means of an insulating body 4, each integrally forming at least one contact element of one of the interfaces. The contact elements of these conductors 5 in combination with the external conductor 3 form the electrical components USB interface 1 and HSD interface 2. The four contact elements of the USB interface 1 formed by the conductors 5 are arranged next to one another in a row. In addition, the contact elements are designed as spring contact tabs which are contacted laterally by complementary contact elements of a mating plug connector (not shown) and which generate a contact pressure through an elastic lateral deflection. In contrast, the four contact elements of the HSD interface 2 formed by the conductors 5 are provided in a quad arrangement and are in the form of contact pins which can be plugged into complementary contact sockets of a mating plug connector (not shown).

Two of the conductors 5 are in the form of single conductors 5*a* and integrate contact elements of both interfaces. On the side of the USB interface 1 these are the two central contact elements and on the side of the HSD interface 2 these are two diagonally opposing contact elements. These two single conductors 5*a* are used for the transmission of data signals.

A further conductor is in the form of a Y-conductor 5*b* and integrates on one of the legs a contact element of the USB interface 1 and on each of the two other legs a contact element of the HSD interface 2. These two contact elements of the HSD interface 2 also lie diagonally opposite one another.

The Y-conductor 5*b* is used, in combination with the fourth conductor 5*c*, for the transmission of a supply voltage. This fourth conductor 5*c* integrates a contact element of the USB interface 1 on one end and on the other end is formed as a spring contact tab which rests under pressure against the inside of the external conductor 3. On the side of the HSD interface 2 the external conductor 3 thus also serves, i.e., like the two corresponding contact elements of the Y-conductor 5*b*, as a contact element for the transmission of electrical supply energy.

Accordingly, in the adapter according to the invention, the electrical energy supply transmitted via two contact elements of the USB interface 1 is distributed to a total of three contact elements of the HSD interface 2, namely two of the contact pins as well as the sleeve-formed contact element formed by the corresponding end of the external conductor 3. In a cable (not shown) connected to the HSD interface 2, in particular a cable in star quad arrangement, two of the wires as well as an external conductor (in particular in the form of a braided external conductor) surrounding the wires are used for the electrical energy supply, while the other two conductors are used for data transmission.

The insulating body 4, formed of an electrically insulating plastic, is designed in two parts in order to simplify manufacture (in particular through injection molding) as well as the assembly of the adapter. The two parts of the insulating body 4 are joined together following assembly of the (inner) conductors 5 by means of a snap-lock connection. The unit consisting of insulating body 4 and (inner) conductors 5 can then be pushed into the external conductor 3, where said unit is fixed in recesses 7 in the insulating body 4 through an engagement of locking tabs 6 of the external conductor 3.

The insulating body 4 forms three projections 8 on the HSD interface 2, of which the two outermost are arranged on the inner side of the external conductor 3, each offset from the center projection with a separation of 90°. This thus results in a separation between the two outer projections 8, different from the other separations, of 180°. This lack of symmetry (in relation to the longitudinal or a transverse axis of the HSD interface 2) ensures that a mating plug connector which has three complementary recesses in a corresponding arrangement can only be plugged into the HSD interface 2 in exactly one alignment. This prevents incorrect plug connections.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. An adapter comprising a first electrical interface and a second electrical interface which each have data contact elements for transmitting data and supply contact elements for transmitting electrical supply energy, wherein the contact elements of the first interface are connected with the corresponding contact elements of the second interface via conductors, such that a first supply contact element of the first interface is connected with two first supply contact elements of the second interface and a second supply contact element of the first interface is connected with a second supply contact element of the second interface, which is in the form of an external conductor surrounding the other contact elements.

2. The adapter of claim 1, wherein the first interface is designed as a USB interface and the second interface is designed as an HSD interface.

3. The adapter of claim 1 wherein the conductors are in the form of stamped and bent components.

4. The adapter of claim 1, wherein the conductors are formed integrally with the associated contact elements.

5. The adapter of claim 4, wherein the conductor connecting the first supply contact element of the first interface with the two first supply contact elements of the second interface is shaped in a Y-form.

6. The adapter of claim 1, wherein the conductor connecting the second supply contact element of the first interface with the second supply contact element of the second interface is designed as a spring contact tab which presses against the second supply contact element of the second interface in a spring-loaded manner.

7. The adapter of claim 6, wherein the second supply contact element of the second interface is sleeve-formed and the conductor makes contact with the inner side thereof.

8. A system comprising an adapter and a cable, said adapter having:

a first electrical interface and a second electrical interface which each have data contact elements for transmitting data and supply contact elements for transmitting electrical supply energy, wherein the contact elements of the first interface are connected with the corresponding contact elements of the second interface via conductors, such that a first supply contact element of the first interface is connected with two first supply contact elements of the second interface and a second supply contact element of the first interface is connected with a second supply contact element of the second interface, which is in the form of an external conductor surrounding the other contact elements; and said cable connected with the adapter via the second interface, said cable having four conductors which are arranged in a star quad arrangement and which are connected in an electrically conductive manner with four contact elements of the second interface, as well as an external conductor which is connected in an electrically conductive manner with the external conductor of the second interface.

9. The system of claim 8, wherein the cable is connected with the adapter via a plug connector with an interface complementary to the second interface of the adapter.

10. The adapter of claim 3, wherein the conductors are formed integrally with the associated contact elements.

11. The adapter of claim 10, wherein the conductor connecting the first supply contact element of the first interface with the two first supply contact elements of the second interface is shaped in a Y-form.

12. The adapter of claim 5, wherein the conductor connecting the second supply contact element of the first interface with the second supply contact element of the second interface is designed as a spring contact tab which presses against the second supply contact element of the second interface in a spring-loaded manner.

13. The adapter of claim 12, wherein the second supply contact element of the second interface is sleeve-formed and the conductor makes contact with the inner side thereof.

14. The system of claim 8, wherein the conductors are formed integrally with the associated contact elements.

15. The system of claim 14, wherein the conductor connecting the first supply contact element of the first interface with the two first supply contact elements of the second interface is shaped in a Y-form.

16. The system of claim 8, wherein the conductor connecting the second supply contact element of the first interface with the second supply contact element of the second interface is designed as a spring contact tab which presses against the second supply contact element of the second interface in a spring-loaded manner.

17. The system of claim 16, wherein the second supply contact element of the second interface is sleeve-formed and the conductor makes contact with the inner side thereof.

* * * * *